US010181386B2

(12) United States Patent
Kanemoto

(10) Patent No.: US 10,181,386 B2
(45) Date of Patent: Jan. 15, 2019

(54) OPERATING DEVICE

(71) Applicant: DENSO CORPORATION, Kariya, Aichi-pref. (JP)

(72) Inventor: Takeo Kanemoto, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 86 days.

(21) Appl. No.: 15/520,500

(22) PCT Filed: Feb. 11, 2016

(86) PCT No.: PCT/JP2016/000711
§ 371 (c)(1),
(2) Date: Apr. 20, 2017

(87) PCT Pub. No.: WO2016/143259
PCT Pub. Date: Sep. 15, 2016

(65) Prior Publication Data

US 2017/0316903 A1 Nov. 2, 2017

(30) Foreign Application Priority Data

Mar. 6, 2015 (JP) ..... 2015-044794

(51) Int. Cl.
*H01H 13/70* (2006.01)
*H01H 25/00* (2006.01)
(Continued)

(52) U.S. Cl.
CPC ..... *H01H 25/041* (2013.01); *H01H 13/70* (2013.01); *H01H 21/00* (2013.01);
(Continued)

(58) Field of Classification Search
CPC ..... H01H 2231/026; H01H 3/00; H01H 3/02; H01H 3/04; H01H 3/06; H01H 3/12;
(Continued)

(56) References Cited

U.S. PATENT DOCUMENTS 5,914,468 A * 6/1999 Nishimura ..... H01H 13/705 200/344
8,772,661 B2 * 7/2014 Liang ..... H01H 3/122 200/341
2012/0228107 A1 * 9/2012 Funakoshi ..... H01H 3/125 200/532

FOREIGN PATENT DOCUMENTS

JP H05047268 A 2/1993
JP 2000251575 A 9/2000

* cited by examiner

*Primary Examiner* — Anthony R. Jimenez
(74) *Attorney, Agent, or Firm* — Harness, Dickey & Pierce, P.L.C.

(57) ABSTRACT

An operating device includes: an operating section that rotates about a predetermined axis; and a shaft part to move integrally with the operating section. The shaft part has a first end and a second end projected in directions opposite from each other along the axis. A guide regulates movement of the shaft part in a radial direction. A first regulation part specifies a position of the shaft part in a thrust direction by contacting the first end of the shaft part. A second regulation part is press-contacted to the second end, such that the first end of the shaft part is made to contact the first regulation part. A locking part is arranged integrally with the second regulation part, and restricts the shaft part from separating from the guide, by contacting the second end.

9 Claims, 8 Drawing Sheets

(51) Int. Cl.
*H01H 25/04* (2006.01)
*H01H 21/00* (2006.01)

(52) U.S. Cl.
CPC ..... *H01H 25/008* (2013.01); *H01H 2217/028* (2013.01); *H01H 2217/03* (2013.01); *H01H 2221/016* (2013.01); *H01H 2223/00* (2013.01); *H01H 2231/026* (2013.01)

(58) Field of Classification Search
CPC .... H01H 3/122; H01H 3/161; H01H 2003/00; H01H 2003/02; H01H 2003/12; H01H 2221/00; H01H 2221/036; H01H 21/00; H01H 25/008; H01H 2217/028; H01H 2217/03; H01H 2221/016; H01H 2223/00; H01H 25/041; H01H 11/00; H01H 13/70; H01H 13/02; H01H 13/12; H01H 13/20; H01H 13/50
USPC ..... 200/5 R
See application file for complete search history.

OPERATING DEVICE

CROSS REFERENCE TO RELATED APPLICATIONAPPLICATIONS

This application is a U.S. National Phase Application under 35 U.S.C. 371 of International Application No. PCT/JP2016/000711 filed on Feb. 11, 2016 and published in Japanese as WO 2016/143259 A1 on Sept. 15, 2016. This application is based on and claims the benefit of priority from Japanese Patent Application No. 2015-44794 filed on Mar. 6, 2015. The entire disclosures of all of the above applications are incorporated herein by reference.

TECHNICAL FIELD

The present disclosure relates to an operating device having an operating section that rotates about a predetermined axis.

BACKGROUND ART

Conventionally, an operating device having an operating section that rotates about a predetermined axis is proposed, in which the operating section is rotated by being pressed by an operator. Further, the operating section is interlocked with a switch that opens and closes an electric point of contact. For example, a through hole is defined in the upper end of a main part of a key switch as an operating section, and a hinge shaft is made to pass through the through hole. The main part of the key switch can be rotated by pressing with a finger. An operating device is proposed (for example, refer to Patent Literature 1), in which a micro switch is pressed through the main part of the key switch.

PRIOR ART LITERATURES

Patent Literature

Patent Literature 1: JP 2000-251575 A

SUMMARY OF INVENTION

In the operating device described in Patent Literature 1, the main part of the key switch as an operating section rotates about an axis passing through the center of the hinge shaft. However, for an operating device concerning this kind of switch, no trial has been made to reduce a backlash such that an operating section is restricted from moving unnecessarily in a thrust direction (namely, a direction parallel to the axis). In order to reduce such backlash, it may be considered that both end surfaces of the operating section in the thrust direction are made in tight contact with the respective end surfaces of, for example, a casing. However, the operating section may become difficult to rotate by friction caused by too much tight contact. In contrast, if the degree of tight contact is lowered, the backlash may not sufficiently be reduced.

Thus, for a conventional operating device, it is necessary to reduce backlash of the operating section in the thrust direction while restricting friction affecting the rotation of the operating section. Moreover, similar necessity is generated for an operating device of other uses, which is unrelated with a switch opening and closing an electric point of contact.

The present disclosure aims to provide an operating device having an operating section that rotates about a predetermined axis, in which backlash of the operating section in the thrust direction is reduced while friction caused by rotation of the operating section is restricted from being generated.

According to an aspect of the present disclosure, an operating device includes: an operating section that rotates about a predetermined axis by being pressed by an operator; a shaft part arranged along the axis to move integrally with the operating section, the shaft part having a first end and a second end projected in directions opposite from each other along the axis; a guide in which a part of the shaft part is inserted in a specific direction, the guide regulating movement of the shaft part in a radial direction; a first regulation part that specifies a position of the shaft part in a thrust direction by contacting the first end of the shaft part, which is inserted in the guide, from the thrust direction; a second regulation part that is elastically deformed when the shaft part is inserted to the guide, the second regulation part being press-contacted to the second end of the shaft part from the thrust direction by a recovering force of the elastic deformation, such that the first end of the shaft part is made to contact the first regulation part; and a locking part arranged integrally with the second regulation part, the locking part restricting the shaft part from moving in an opposite direction opposite from the specific direction to separate from the guide, by contacting the second end of the shaft part.

According to the operating device configured in this way, a part of the shaft part arranged along the axis of the rotation of the operating section is inserted in the guide in the specific direction, and the guide regulates movement of the inserted shaft part in the radial direction (namely, the direction perpendicular to the axis). At this time, the first regulation part is in contact with the first end of the shaft part inserted in the guide from the thrust direction, such that the position of the shaft part in the thrust direction is specified. Moreover, at this time, the second regulation part is elastically deformed when the part of the shaft part is inserted to the guide, and is press-contacted to the second end of the shaft part from the thrust direction due to the recovering force from the elastic deformation. Then, the first end of the shaft part is in contact with the first regulation part in appropriate manner. For this reason, the position of the shaft part in the thrust direction is stably maintained at the position where the first end is in contact with the first regulation part. Thus, a backlash in the thrust direction can be reduced for the operating section which operates integrally with the shaft part.

Moreover, the locking part defined integrally with the second regulation part is in contact with the second end of the shaft part inserted to the guide, thereby restricting the shaft part from moving and separating from the guide in the opposite direction opposite from the specific direction. For this reason, as mentioned above, the configuration for reducing backlash of the operating section in the thrust direction is stably maintained. Furthermore, since the backlash in the thrust direction is reduced using the recovering force from the elastic deformation of the second regulation part, friction that restricts the rotation of the operating section can be controlled. Moreover, the configuration can also be simplified since the locking part is configured integrally with the second regulation part.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

An embodiment is described with reference to the drawings.

Figure 1:
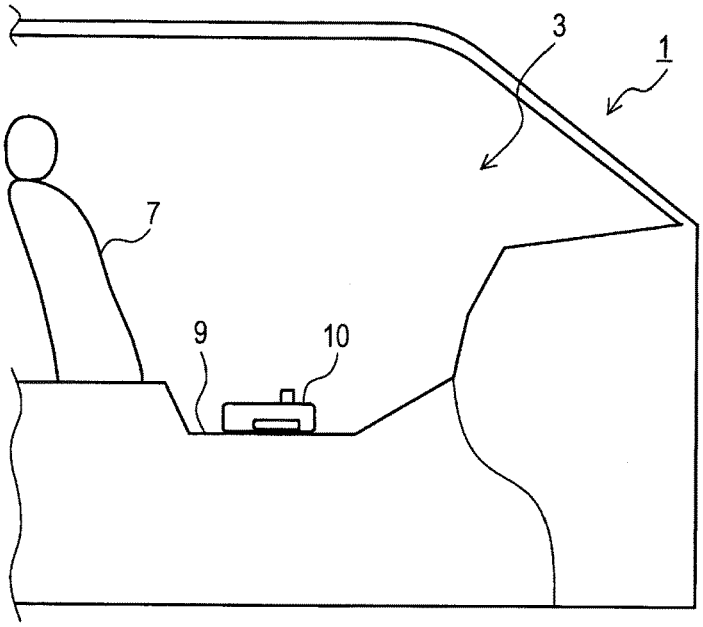
FIG. 1 is a diagram illustrating an operating device according to an embodiment from a lateral side in a vehicle.
Figure 2:
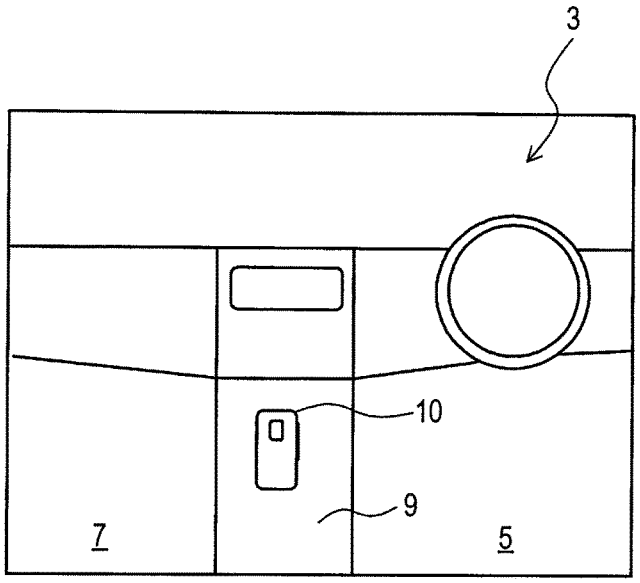
FIG. 2 is a diagram illustrating an arrangement of the operating device from the upper side.
Figure 3:
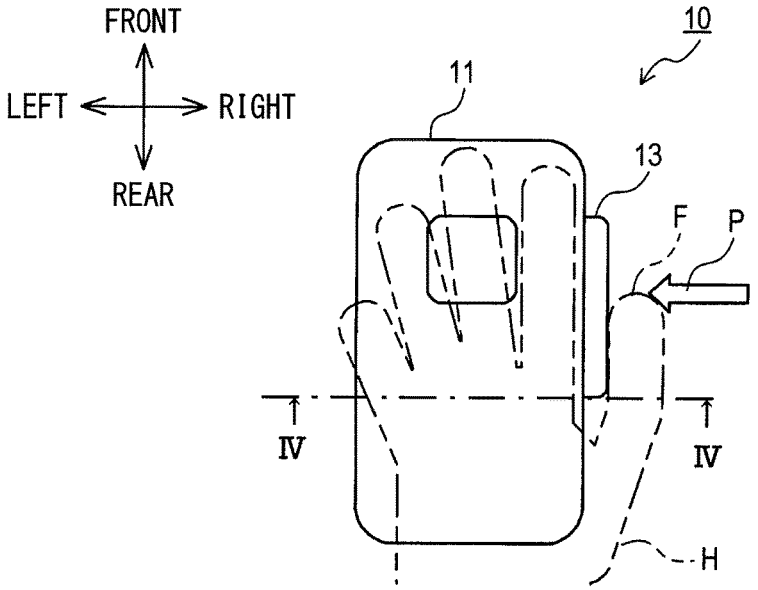
FIG. 3 is a diagram schematically illustrating an operation method of the operating device.

As shown in FIG. 1 and FIG. 2, a vehicle 1 in which an operating device 10 according to an embodiment is disposed has a console 9 located between a driver seat 5 and a front passenger seat 7 inside of a cabin 3. The operating device 10 is arranged on the upper surface of the console 9. As shown in FIG. 3, the operating device 10 has an operating section 13 projected from a right side of a case 11. A driver (not shown: an example of an operator) seated on the driver seat 5 can press the operating section 13 with the thumb F of the left hand H, as shown in an arrow direction P, to the inner side of the case 11.

Hereafter, front, rear, left, right, up and down of the vehicle 1 in which the operating device 10 is installed in this way may be called as, for convenience, front, rear, left, right, up and down of the operating device 10. However, these directions are specified only for explaining briefly the relative spatial relationship of components which configure the operating device 10. The operating device 10 can be oriented suitably when actually being used.

Figure 4:
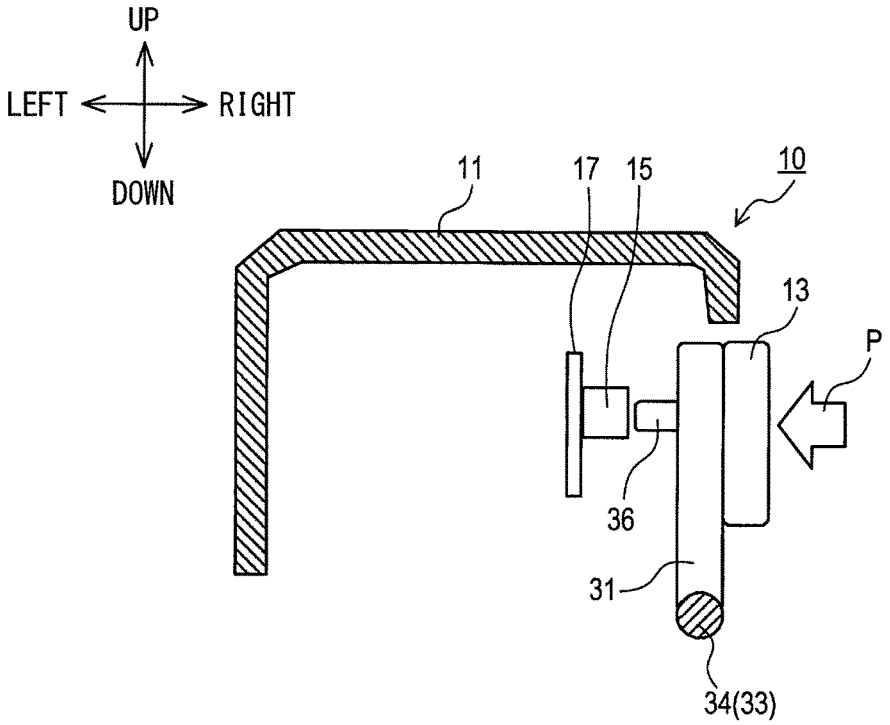
FIG. 4 is a schematic cross-sectional view taken along a line IV-IV in FIG. 3.
Figure 5:
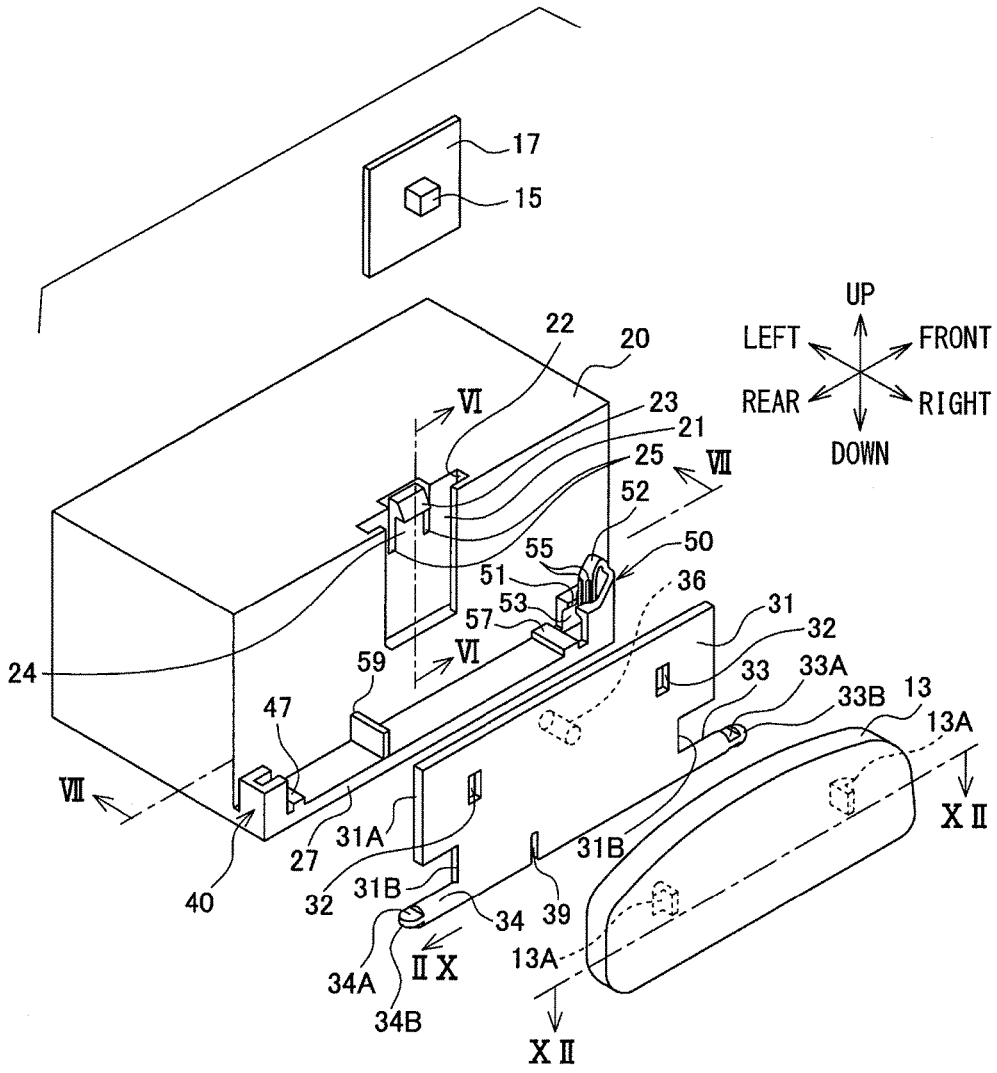
FIG. 5 is an exploded perspective view illustrating the operating device.
Figure 6:
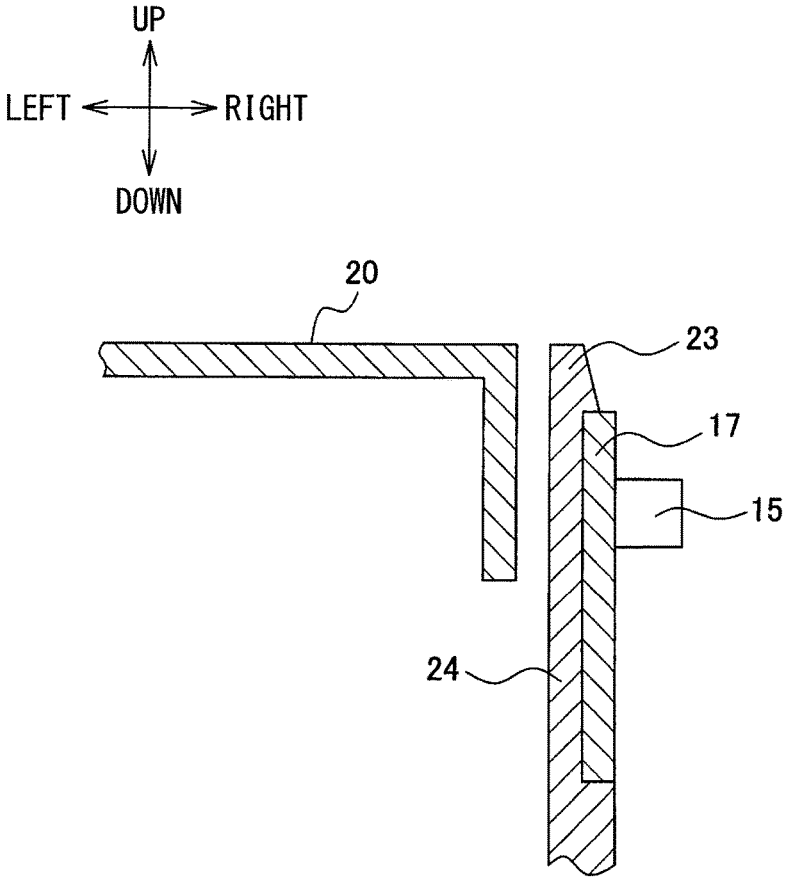
FIG. 6 is a cross-sectional view taken along a line VI-VI in FIG. 5.

As roughly shown in FIG. 4, a circuit board 17 is disposed inside the case 11, and a tactile switch 15 is mounted on the circuit board 17. A board part 31 to which the operating section 13 is connected is able to rotate about an axis of a shaft part 33, 34. The board part 31 has a protrusion part 36 at a position opposing to the tactile switch 15 (strictly, at a position opposing to a push button of the tactile switch 15). For this reason, when the operating section 13 is pushed in as mentioned above, the board part 31 and the protrusion part 36 rotate about the axis of the shaft part 33, 34, and the protrusion part 36 presses the push button of the tactile switch 15. In FIG. 4 to FIG. 6, only the push button is illustrated, of the tactile switch 15, with the referential mark 15.

When the thumb F separates from the operating section 13, the thrust force from the thumb F pushing the operating section 13 is lost. The operating section 13 also returns to the original position due to the recovering force added to the push button of the tactile switch 15.

FIG. 5 is an exploded perspective view illustrating components of a support mechanism of the circuit board 17 and the operating section 13. As shown in FIG. 5, the support mechanism mainly includes a case 20. The right side of the case 20 has a rectangular recess portion 21 extending from the upper end of the case 20, to accept the circuit board 17. A length (namely, depth) of the recess portion 21 is longer than a length (namely, thickness) of the circuit board 17 in the left-right direction. A length of the recess portion 21 in the up-and-down direction is longer than a length of the circuit board 17 in the up-and-down direction. A length of the recess portion 21 in the front-rear direction is shorter than a length of the circuit board 17 in the front-rear direction. A groove 22 is defined to extend in the up-and-down direction along the internal surface of the recess portion 21, at each of the front end and the rear end. The groove 22 has a rectangle shape with a width which is the same as the thickness of the circuit board 17. A sum of the depth of the two grooves 22 and the length of the recess portion 21 in the front-rear direction is slightly longer than the length of the circuit board 17 in the front-rear direction. For this reason, the circuit board 17 can be inserted into the recess portion 21 from the upper side in the state where the front edge and the rear edge of the circuit board 17 are fitted to the respective grooves 22.

As shown in FIG. 6, the recess portion 21 has a hook 23 engaged with the upper end of the circuit board 17, when the circuit board 17 is inserted in the recess portion 21 to the lowermost part of the recess portion 21. Although FIG. 6 is a sectional view taken along a line VI-VI of FIG. 5, the front configuration of the hook 23 is omitted in FIG. 6. A board spring part 24 is defined by providing a cutout 25 in the case 20, and the hook 23 is defined at the tip end of the board spring part 24 to protrude rightward. When the circuit board 17 is inserted in the recess portion 21, the board spring part 24 is elastically deformed to displace the hook 23 (namely, leftward). After the completion of insertion, as shown in FIG. 6, the hook 23 is engaged with the upper end of the circuit board 17. Due to the engagement, the circuit board 17 and the tactile switch 15 attached to the circuit board 17 are positioned easily and accurately relative to the case 20.

As shown in FIG. 5, a plate-shaped support part 27 is projected from the right-side lower end of the case 20 to be perpendicular to the up-and-down direction. The upper surface of the support part 27 has a first bearing part 40 which receives the shaft part 34 projected rearward from the board part 31, and a second bearing part 50 which receives the shaft part 33 projected frontward from the board part 31.

The board part 31 has an approximately rectangle board shape in which the long side extends in the front-rear direction. A rectangular cutout part 31B is defined at each end of one long side (long side on the lower side in FIG. 5). At the front side cutout part 31B, the shaft part 33 is projected frontward along the long side. At the rear side cutout part 31B, the shaft part 34 is projected rearward along the long side. The shaft part 33, 34 is configured as a series of shaft part in which the axis lines are aligned in the same straight line state. The shaft part 33, 34 has a cylindrical shape with the same diameter as the thickness of the board part 31, except for the ends.

A tip adjacency part 33A of the shaft part 33 adjacent to the tip end has a plane shape defined by cutting out from both sides in the radial direction. A tip part 33B of the shaft part 33 (a second end) has a hemispherical shape without being cut. A tip adjacency part 34A of the shaft part 34 adjacent to the tip end and a tip part 34B of the shaft part 34 (a first end) are configured as a series of plane shape defined by cutting out from both sides in the radial direction. The tip part 34B has a plane shape defined by cutting out a hemispherical component from both sides in the radial direction (what is called SR form). While the tip adjacency part 33A of the shaft part 33, and the tip adjacency part 34A and the tip part 34B of the shaft part 34 are configured to have the plane shape, the normal direction of the plane shape is perpendicular to the normal direction of the board part 31.

Next, the first bearing part 40 and the second bearing part 50 are explained. The configurations with the referential marks of 40-47 or 50-57 to be explained below are molded by resin integrally with the case 20 and the support part 27. However, this resin may be desirably a material different from a resin integrally forming the board part 31 and the shaft part 33, 34 to reduce a friction sound therebetween.

Figure 7:
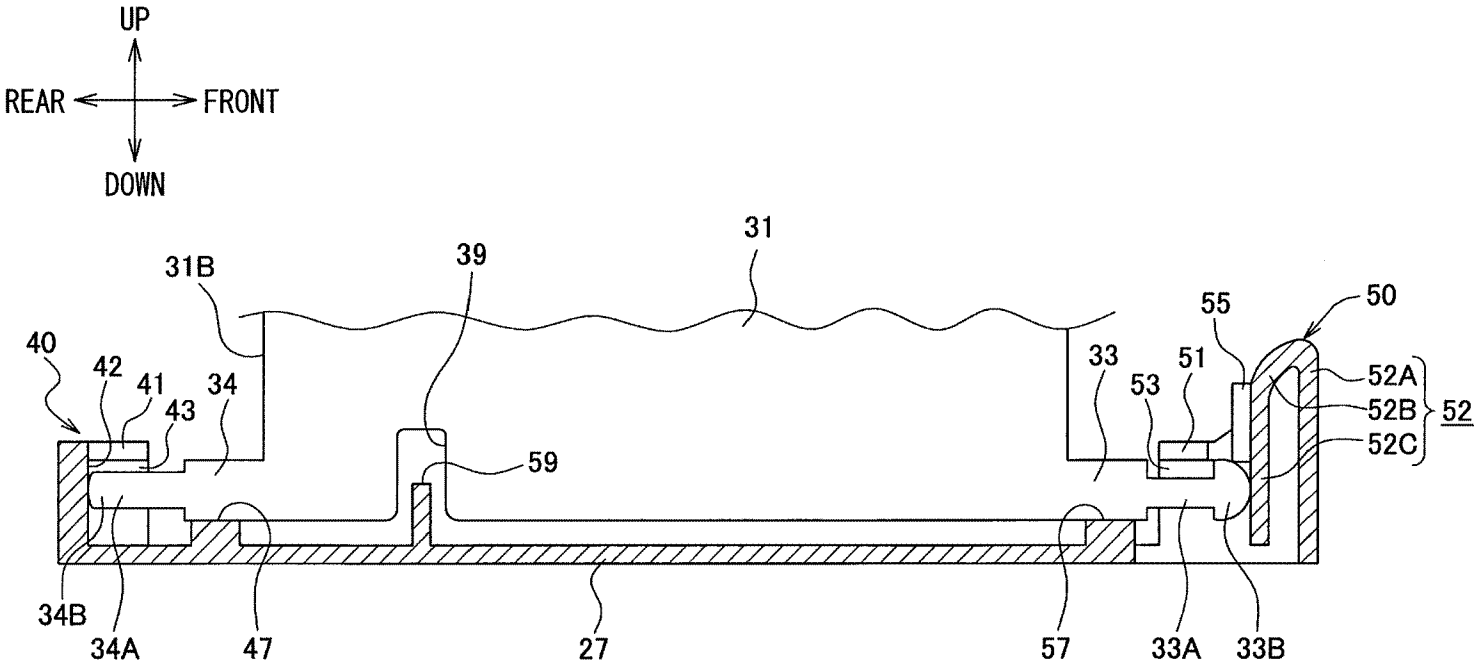
FIG. 7 is a cross-sectional view taken along a line VII-VII in FIG. 5.
Figure 8:
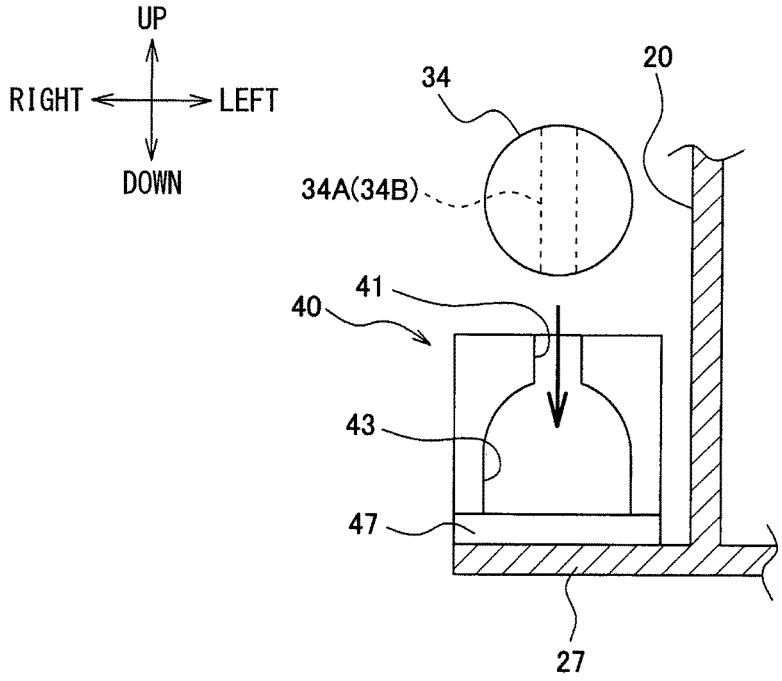
FIG. 8 is a view illustrating a first bearing part seen in an arrow direction IIX in FIG. 5 when a shaft part is being attached.

As shown in FIG. 7 and FIG. 8, the first bearing part 40 has a slit 41, a first regulation part 42, and a guide surface 43. The slit 41 is narrower than the diameter of the shaft part 34, and has a width into which the tip adjacency part 34A and the tip part 34B can be inserted when the normal direction of the tip adjacency part 34A and the tip part 34B is set in the left-right direction. The first regulation part 42 is located on the rear side of the slit 41, and has a plate shape perpendicular to the front-rear direction. The guide surface 43 has a cylindrical surface shape under the slit 41, and supports the tip adjacency part 34A and the tip part 34B to be rotatable about the axis. Furthermore, a step part 47 having a rectangular parallelepiped shape is projected from the upper surface of the support part 27, on the front side of the slit 41 and the guide surface 43.

Figure 9:
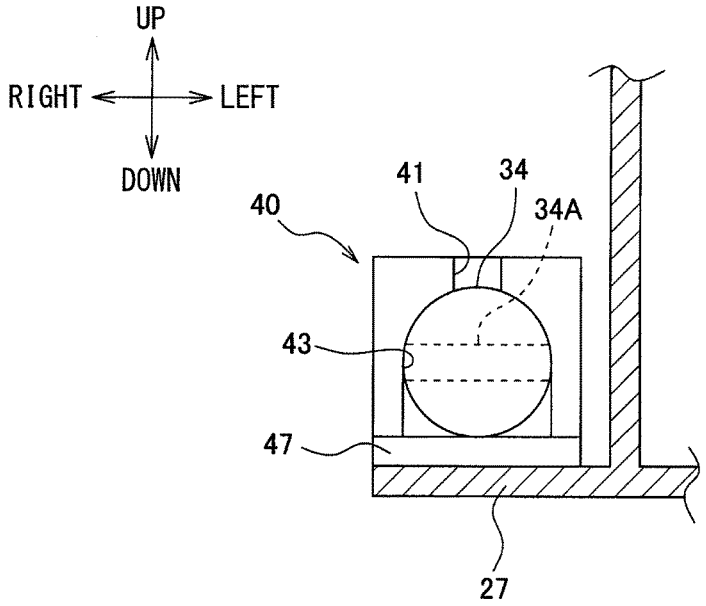
FIG. 9 is a view illustrating the first bearing part seen in the arrow direction IIX in FIG. 5 after the shaft part has been attached.

The tip adjacency part 34A and the tip part 34B of the first bearing part 40 configured in this way are inserted in the slit 41 in the state where the normal direction of the tip adjacency part 34A and the tip part 34B is set in the left-right direction, as shown in FIG. 8. Then, when the shaft part 34 rotates about the axis, the first bearing part 40 becomes to be able to support the shaft part 34. At this time, as shown in FIG. 9, the cylindrical portion of the shaft part 34 on the front side of the tip adjacency part 34A is in contact with the step part 47, such that the position of the axis of the shaft part 34 (in the radial direction) is specified within the guide surface 43. Moreover, when the shaft part 34 is biased rearward, to be mentioned below, the tip part 34B is in contact with the front surface of the first regulation part 42, such that the position of the shaft part 34 is specified in the front-rear direction (namely, thrust direction).

Figure 10:
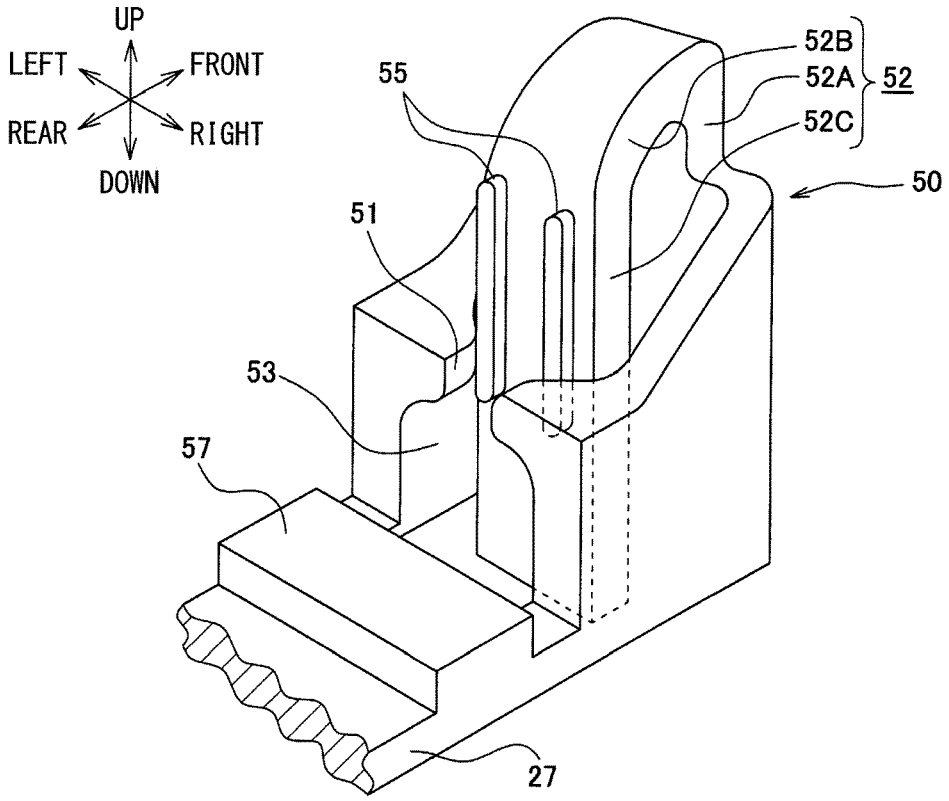
FIG. 10 is an enlarged perspective view illustrating a second bearing part of the operating device.

As shown in FIG. 7 and FIG. 10, the second bearing part 50 has a slit 51 and a guide surface 53, similarly to the first bearing part 40. The second bearing part 50 further has a second regulation part 52 different from the first regulation part 42. The slit 51 is narrower than the diameter of the shaft part 33, and has a width into which the tip adjacency part 33A can be inserted when the normal direction of the tip adjacency part 33A is set in the left-right direction. The guide surface 53 has a cylindrical surface shape under the slit 51, and supports the tip adjacency part 33A to be rotatable about the axis. A step part 57 having a rectangular parallelepiped shape is projected from the upper surface of the support part 27, on the rear side of the slit 51 and the guide surface 53. The front side of the step part 57 defines a space in which the support part 27 passes through up and down. The second regulation part 52 which biases the tip part 33B rearward, to be explained below, is disposed at the front end of the space.

The second regulation part 52 has a first portion 52A extending upwards along the front end of the case 20, a second portion 52B extending from the upper end of the first portion 52A to be curved downward in the rear-side slanting direction, and a third portion 52C extending from the rear end of the second portion 52B downward. The second regulation part 52 is elastically deformed at a connection between the second portion 52B and the first portion 52A or the third portion 52C. Further, the second portion 52B itself is elastically deformed. The third portion 52C is configured in a plate shape perpendicular to the front-rear direction. Moreover, a clearance dimension between the front surface of the first regulation part 42 and the rear surface of the third portion 52C is set to be slightly smaller than a dimension between the end of the tip part 33B and the end of the tip part 34B in the state where no external force is added to the second regulation part 52.

For this reason, when the tip part 34B and the tip adjacency parts 34A and 33A are inserted in the corresponding slit 41, 51 in the state where the normal direction of the tip part 34B and the tip adjacency parts 34A and 33A is set in the left-right direction, the second regulation part 52 is elastically deformed during the insertion. Then, the tip part 33B of the shaft part 33 receives the biasing force from the third portion 52C of the second regulation part 52 rearward after the insertion. As a result, the tip part 34B of the shaft part 34 is in contact with the front surface of the first regulation part 42. Moreover, at this time, the cylindrical portion of the shaft part 33 on the rear side of the tip adjacency part 33A is in contact with the step part 57, thereby the position of the axis of the shaft part 33 (in the radial direction) is specified within the guide surface 53. In addition, the shaft part 33, 34 is movable in the radial direction when the tip part 34B and the tip adjacency parts 34A and 33A are inserted in the corresponding slit 41, 51. Meanwhile, after the insertion, when the board part 31 is somewhat rotated upwards about the axis of the shaft part 33, 34, the movement in the radial direction is regulated. That is, the guide surface 43, 53 and the step part 47, 57 correspond to an example of a guide.

Figure 11:
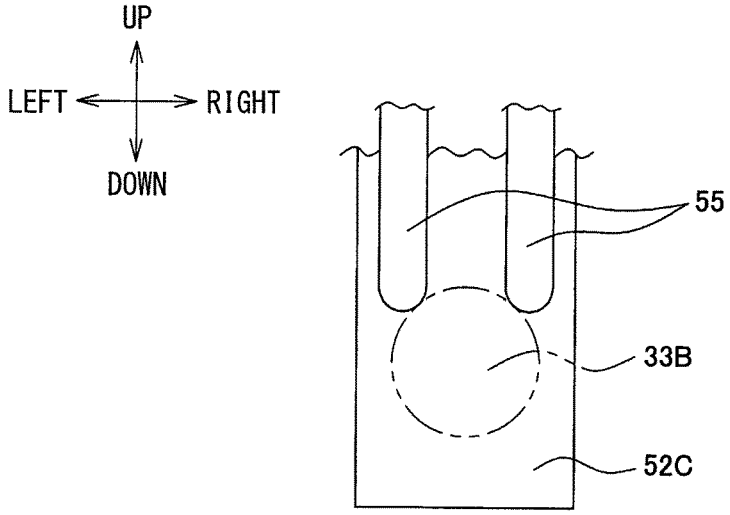
FIG. 11 is a diagram illustrating effects of a locking part of the second bearing part.

Moreover, the third portion 52C integrally includes a pair of locking parts 55 directly above the contact position between the third portion 52C and the tip part 33B in this state. The locking part 55 is configured in a rib shape extending in the up-and-down direction, at positions symmetrical to a surface defined by being extended upward from the axis of the shaft part 33, 34. The upper and lower end surfaces the locking part 55 is chamfered to have an arc shape, in view of the front-rear direction. For this reason, when the tip adjacency part 33A is inserted in the slit 51, the tip part 33B is guided between the pair of locking parts 55, and presses the pair of locking parts 55 frontward. After the tip adjacency part 33A finishes passing through the slit 51, as shown in FIG. 11, the respective locking part 55 is in contact with the tip part 33B from the upper right side and the upper left side.

As shown in FIG. 5 and FIG. 7, an engagement piece 59 is projected from the upper surface of the support part 27 at a position between the step part 47 and the step part 57, and is configured in a plate shape perpendicular to the front-rear direction. The engagement piece 59 has a height projected to cross the axis of the shaft part 33, 34. A cutout part 39 which accepts the engagement piece 59 is defined in the board part 31. The cutout part 39 has a size not to contact the engagement piece 59, while the board part 31 rotates about the axis, in the state where the shaft part 33 and the shaft part 34 are in contact with the third portion 52C and the first regulation part 42 respectively. Moreover, the size of the cutout part 39 is set in a manner that the board part 31 interferes with the engagement piece 59 before the elastic deformation exceeds an allowable level in the second regulation part 52, if the board part 31 moves frontward to elastically deform the second regulation part 52 such that the tip part 34B separates from the first regulation part 42.

Figure 12:
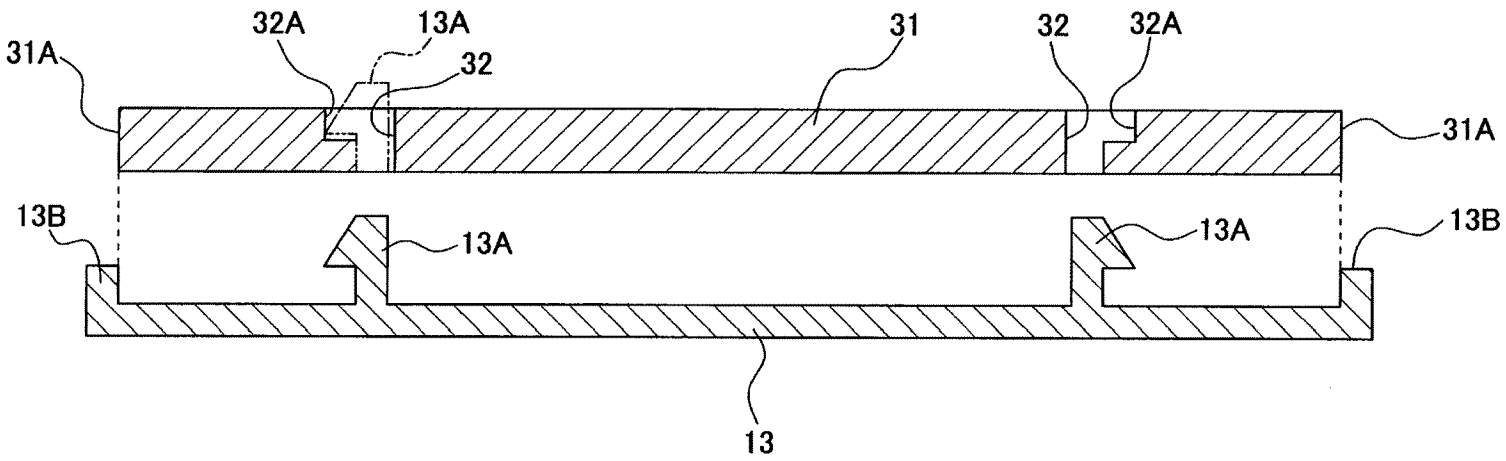
FIG. 12 is a cross-sectional view taken along a line XII-XII in FIG. 5.

As shown in FIG. 5 and FIG. 12, the operating section 13 is mounted to a portion of the board part 31 adjacent to the free end than the cutout part 31B on the side opposite from the side on which the protrusion part 36 is projected. A pair of rectangular holes 32 are formed in the portion. The operating section 13 has a pair of hooks 13A which are elastically deformed and engaged with the respective rectangular holes 32, such that the operating section 13 is mounted to the board part 31. Moreover, as shown in FIG. 12, a peripheral part 13B of the operating section 13 is projected in the same direction as the projection direction of the hook 13A. The peripheral part 13B is engaged with an end periphery 31A of the board part 31, on the front side and the rear side, from the outer periphery side. Furthermore, each of the rectangular holes 32 has a large diameter part 32A on the far side from the hook 13A in the insertion direction. The hook head of each hook 13A is engaged with each large diameter part 32A. Due to such engagement, the operating section 13 is connected to the board part 31 without a gap, and both operations are united with each other. As a result, the shaft part 33, 34 can operate integrally with the operating section 13 as one-piece, and the operation to the tactile switch 15 described above is attained.

According to the embodiment, the following effects are acquired.

[1A] As mentioned above, according to the operating device 10, the tip part 33B of the shaft part 33 receives the biasing force from the third portion 52C of the second regulation part 52 rearward. As a result, the tip part 34B of the shaft part 34 is in contact with the front surface of the first regulation part 42. For this reason, the position of the shaft part 33, 34 in the thrust direction is stably maintained at the position where the tip part 34B is in contact with the front surface of the first regulation part 42. Thus, backlash in the thrust direction can be reduced for the operating section 13 which operates integrally with the shaft part 33, 34.

Moreover, it is also considered that the biasing force is provided by, for example, a spring. However, in this embodiment, the second regulation part 52 which is integrally molded with the first bearing part 40 and the second bearing part 50 provides the biasing force. For this reason, compared with the case where the spring is used, the configuration can be simplified to reduce the number of components and the manufacturing cost. Moreover, according to this embodiment, adjustment in the spring force (namely, the biasing force) becomes easy by using such a plastic spring.

[1B] Moreover, the position of the shaft part 33 in the radial direction is defined by the guide surface 53 and the step part 57, and the position of the shaft part 34 in the radial direction is defined by the guide surface 43 and the step part 47. Furthermore, the pair of locking parts 55 contacts the tip part 33B from the upper side to the lower side (in the specific direction). Accordingly, the shaft part 33 is restricted from moving upward (in the opposite direction opposite from the specific direction), and is restricted from separating from the guide surface 53. For this reason, as mentioned above, the configuration for reducing the backlash of the operating section 13 in the thrust direction is stably maintained.

[1C] Moreover, according to the operating device 10, the backlash in the thrust direction is reduced using the recovering force from the elastic deformation of the second regulation part 52. For this reason, the friction that restricts the rotation of the operating section 13 can be reduced, compared with a case where backlash is reduced by making, for example, a casing to contact the front/rear end (end surface in the thrust direction) of the operating section 13.

[1D] The locking parts 55 contact the tip part 33B respectively from the upper right side and the upper left side, at two points across a plane defined to be extended from the axis upward (in the opposite direction opposite form the specific direction). For this reason, the center position of the tip part 33B is defined by the pair of locking parts 55, such that the configuration for reducing the backlash in the thrust direction can be further stably maintained. Furthermore, since the shaft part 33 is in contact with the step part 57 on the lower side, the shaft part 33 is supported from three directions different from each other around the axis, such that the center position is further stabilized. The configuration can be simplified by forming the locking part 55 integrally with the third portion 52C.

[1E] Moreover, according to the operating device 10, when the operating section 13 stops being pressed, the operating section 13 returns to the original position according to the recovering force from the push button of the tactile switch 15. For this reason, the configuration of the operating device 10 can be simplified as a whole to reduce the manufacturing cost.

[1F] In case where the board part 31 moves frontward to elastically deform the second regulation part 52 such that the tip part 34B separates from the first regulation part 42, the cutout part 39 interferes with the engagement piece 59 before the elastic deformation exceeds the allowable level in the second regulation part 52. For this reason, if a frontward external force is added to the operating section 13, the board part 31 is restricted from moving frontward beyond the allowable level of the elastic deformation in the second regulation part 52, such that the second regulation part 52 is not damaged. Moreover, the cutout part 39 is not in contact with the board part 31 irrespective of the rotation condition of the board part 31 in the state where the shaft part 33, 34 is interposed between the second regulation part 52 and the first regulation part 42. Therefore, the engagement piece 59 is restricted from inhibiting the rotation of the board part 31 and the operating section 13.

[1G] The guide surface 43 and the step part 47 are located at the position near the first regulation part 42 than a halfway point between the first regulation part 42 and the second regulation part 52, and the guide surface 53 and the step part 57 are located at the position near the second regulation part 52 than the halfway point. For this reason, the position of the both ends (namely, the tip part 33B and the tip part 34B) of the shaft part 33, 34 in the radial direction is specified favorably, as a shaft part in the embodiment, and the configuration for reducing backlash in the thrust direction can be further stably maintained.

[1H] Each portion for the first bearing part 40, each portion for the second bearing part 50, the step part 47, 57 and the engagement piece 59 are fabricated integrally with the case 20 by resin through the support part 27. For this reason, according to the operating device 10, the spatial relationship among them can be favorably maintained, and the axis can be stably maintained at a predetermined position while reducing the backlash. Moreover, the accuracy in the relative position among theme can also be easily raised by the integral molding.

[1I] The operating device 10 is mounted in the vehicle 1, and the operating section 13 rotates around the axis which is in agreement with the front-rear direction of the vehicle 1. If the operating section mounted in the vehicle 1 has a backlash in the front-rear direction, the position of the operating section may be changed at the time of acceleration or deceleration of the vehicle 1, and the operativity of the operating section may fall to affect the user's feeling. According to the operating device 10, the backlash of the operating section 13 in the thrust direction (namely, the front-rear direction of the vehicle 1) can be reduced, while the friction inhibiting the rotation of the operating section 13 can be reduced. Therefore, the above-described fall in the operativity or the user's feeling can be controlled while maintaining the smooth motion of the operating section 13.

According to this embodiment, the operating device 10 is disposed on the upper surface of the console 9 such that a driver can place the left hand H all the time while driving. Therefore, as mentioned above, the backlash in the thrust direction can be restricted to control the fall in the user's feeling much more notably. Furthermore, such effects appear much more notably in a luxury car with little vibration in the cabin 3.

In addition, such effects may be produced even if the direction of the axis is not completely in agreement with the front-rear direction of the vehicle 1. For example, when the direction of the axis is located within a cone with an angle smaller than or equal to 45° , relative to the front-rear direction of the vehicle 1, the above-described effects may arise similarly. That is, when the direction of the axis is disposed mostly in agreement with the front-rear direction of the vehicle 1, the effects may arise similarly.

[1J] A portion of the tip part 34B which is in contact with the first regulation part 42 has a sphere surface shape, and the front surface of the first regulation part 42 which is in contact with the portion has a plane shape. Moreover, a portion of the tip part 33B which is in contact with the third portion 52C has a sphere surface shape, and the rear surface of the third portion 52C which is in contact the portion has a plane shape. Since the friction decreases due to the point contact at the both cites, the operating section 13 can be rotated more smoothly.

As mentioned above, although the embodiment is described, the present disclosure may be implemented within various forms, without being limited to the embodiment.

[2A] In the embodiment, the pair of locking parts 55 is in contact with the tip part 33B at two points from the upper right side and the upper left side, however, is not limited to this. For example, the locking part may be defined on the third portion 52C as one approximately rectangular parallelepiped projection which includes the pair of locking parts 55 of the embodiment. However, in this case, the locking part is in contact with the tip part 33B at one point on the upper side. The center position of the tip part 33B can be made stable when the locking part 55 contacts at two points like the embodiment.

[2B] In the embodiment, the pair of shaft parts 33, 34 is projected from the board part 31 at the both ends on the front side and the rear side, however, is not limited to this. For example, a shaft part may be one metal stick. In that case, the board part 31 may be connected to the metal stick through a screw.

[2C] In the embodiment, the operating device 10 is applied to the operating section 13 for pressing the tactile switch 15 in the vehicle, however, is not limited to this. For example, the operating device is applicable also to a rotation type operating section for unlocking a suitcase.

[2D] Moreover, the engagement piece 59 and the cutout part 39 in the embodiment may be omitted. Also in that case, the above-mentioned effects of [1A]-[1E] and [1G]-[1J] are produced similarly.

[2E] The function of one component in the embodiment may be distributed to plural components, or the functions of plural components may be united to one component. Moreover, a part of the configuration in the embodiment may be omitted. Moreover, at least a part of the configuration in the embodiment may be added or replaced relative to a configuration of the other embodiment. In addition, all the modes contained in the technical scope specified by only wording described in claims are included by the present disclosure.

What is claimed is:

1. An operating device comprising:

an operating section that rotates about a predetermined axis by being pressed by an operator;

a shaft part arranged along the axis to move integrally with the operating section, the shaft part having a first end and a second end projected in directions opposite from each other along the axis;

a guide in which a part of the shaft part is inserted in a specific direction, the guide regulating movement of the shaft part in a radial direction;

a first regulation part that specifies a position of the shaft part in a thrust direction by contacting the first end of the shaft part, which is inserted in the guide, from the thrust direction;

a second regulation part that is elastically deformed when the shaft part is inserted to the guide, the second regulation part being press-contacted to the second end of the shaft part from the thrust direction by a recovering force from the elastic deformation, such that the first end of the shaft part is made to contact the first regulation part; and a locking part arranged integrally with the second regulation part, the locking part restricting the shaft part from moving in an opposite direction opposite from the specific direction to separate from the guide, by contacting the second end of the shaft part.

2. The operating device according to claim 1, wherein the locking part is in contact with the second end at two points across a plane defined by being extended from the axis in the opposite direction opposite from the specific direction.

3. The operating device according to claim 1, further comprising:

an engagement piece projected to cross the axis and having a plate shape, a relative position of the engagement piece relative to the first regulation part being fixed; and a cutout part formed to range over at least one of the shaft part, the operating section and a component that operates integrally with the shaft part and the operating section, the cutout part accepting the engagement piece when the shaft part and the operating section rotate around the axis in a state where the first end is in contact with the first regulation part, wherein the cutout part and the engagement piece interfere with each other when the shaft part moves toward the second regulation part beyond an allowable range of the elastic deformation.

4. The operating device according to claim 1, wherein the guide is disposed at a position adjacent to the first regulation part and the second regulation part.

5. The operating device according to claim 1, wherein the guide, the first regulation part, the second regulation part, and the locking part are integrally molded by resin.

6. The operating device according to claim 1, wherein the first end and the first regulation part contact in a point contact, and the second end and the second regulation part contact in a point contact.

7. The operating device according to claim 1, wherein the operating section is mounted in a vehicle, and the operating section is arranged so that the axis is in agreement with a front-rear direction of the vehicle.

8. The operating device according to claim 1, wherein the operating section is interlocked with a switch which opens and closes an electric point of contact.

9. The operating device according to claim 8, wherein the switch is a tactile switch, a push button of the tactile switch is pressed by the operating section in an interlocked manner when the operating section is pressed by the operator, and the operating section returns to an original position due to a recovering force added to the push button of the tactile switch when the operating section stops being pressed by the operator.

* * * * *